US005957708A

United States Patent [19]

Lin

[11] Patent Number: 5,957,708

[45] Date of Patent: Sep. 28, 1999

[54] CONNECTOR WITH EJECTING AND SECURING FUNCTIONS

[75] Inventor: Ming-Sheng Lin, Taipei, Taiwan

[73] Assignee: Tekcon Electronics Corp., Taipei Hsien, Taiwan

[21] Appl. No.: 08/932,297

[22] Filed: Sep. 17, 1997

[51] Int. Cl.[6] ..... H01R 13/62

[52] U.S. Cl. ..... 439/157; 439/160

[58] Field of Search ..... 439/160, 157

[56] References Cited

U.S. PATENT DOCUMENTS

| | | | |
|---|---|---|---|
| 5,429,523 | 7/1995 | Tondreault | 439/157 |
| 5,443,394 | 8/1995 | Billman et al. | 439/157 |
| 5,558,528 | 9/1996 | Cheng et al. | 439/160 |
| 5,690,499 | 11/1997 | Howell et al. | 439/157 |
| 5,766,031 | 6/1998 | Yeh | 439/328 |
| 5,775,925 | 7/1998 | Tondreault | 439/157 |

*Primary Examiner*—Steven L. Stephan
*Assistant Examiner*—Hae Moon Hyeon
*Attorney, Agent, or Firm*—Rosenberg, Klein & Bilker

[57] ABSTRACT

A type of connector with ejecting and securing functions, comprising a seat body, several pairs of terminals and two catch hooks; on the left and right ends of said seat body is a corresponding catch hook seat; each catch hook seat has two side plates and a center post; on the inside wall of the two side plates is respectively an insert groove; on the inner part of the inner wall of the two side plates is a first positioning body; on the inside wall in said first positioning body is the formation of a matching surface; on two sides of the center post is respectively a guide channel; on the bottom of the guide channel are pinholes; several pairs of terminals are fixed onto the seat body; each catch hook is composed of two side bodies, a pushing part and an ejecting part; on the upper and lower parts of the two side bodies are respectively connected with a pushing part and an ejecting part; on the outside wall of the two side bodies is the insert body; on the lower part inside the two side bodies is a matching surface that corresponds with the matching surface of the catch hook seat; on the upper part of the matching surface is a positioning body that may push against the center part of the first positioning body of the seat body; the two catch hooks are joined by key pins that are inserted into the pinholes of the catch hook seat at two ends of the seat body.

2 Claims, 7 Drawing Sheets

CONNECTOR WITH EJECTING AND SECURING FUNCTIONS

DESCRIPTION OF PRIOR ART

As illustrated in FIG. 9 which is a prior art of connector; said connector comprises a seat body 10*a*, several pairs of terminals 11*a* and two catch hooks 12*a*; the terminals 11*a* are fixed in the seat body 10; the upper parts of the terminals 11*a* are exposed into the insert groove 13*a* of the seat body 10*a*, to facilitate electrical connection with an interface card or other cards; the lower parts of the terminals are exposed to the bottom of the seat body 10*a*, to facilitate insertion to the circuit board, to achieve the purpose of electrical connection of the insert card with the circuit of the circuit board; on the left and right ends of the seat body 10*a* is a catch hook seat 16*a* connected with corresponding catch hook 12*a*; on the upper and lower ends of the catch hook 12*a* are respectively a catching part 14*a* and a ejecting part 15*a*; said catching part 14*a* may be secured onto the two sides of the insert card, to increase the steadiness of the insert card. When the top of the catch hook 12*a* is depressed, the catching part 14*a* will move away from two sides of the insert card, which will drive the ejecting part 15*a* at the lower end of the catch hook 12*a* to move upward, to push the bottom of the insert card, so that the insert card moves upward and away from the seat body 10*a* of the connector, to enable the separation of the insert card from the connector without using too much force.

However, in the above prior art of connector, when the upper part of the catch hook 12*a* is pushed inward, the side plate of the catch hook 12*a* will push against the upper portion with a larger thickness of the positioning body 17*a* of the catch hook seat 16*a*; which will easily result in breaking or cracking on the upper part of the positioning body 17*a*; and when the catch hook 12*a* is securing the insert card, the catch hook 12*a* will use only the catching part 14*a* to secure onto the two sides of the insert card; the catch hook 12*a* does not have an excellent securing function, and would easily sway or loosen, so that the two catch hooks 12*a* will not be able to secure the insert card steadily. Moreover, when the ejecting part 15*a* of the catch hook 12*a* pushes the insert card to a certain extent, the lower part of the catch hook 12*a* will push against the inside wall of the positioning body 17*a* of the catch hook seat 16*a*; and since the pointed end of the catch hook 12*a* will push against the inside wall of the positioning body 17*a*, so the area of contact is small, it will easily slide away and cannot be secured in place; also, the catch hook 12*a* is easily damaged; and the catch hook 12*a* is joined by the key 18*a* to the catch hook seat 16*a*; the edge of said key 18*a* and the pinhole of the catch hook seat 16*a* will easily be broken.

SUMMARY OF THE INVENTION

The primary purpose of the subject invention is to present a type of connector with ejecting and securing functions; said connector comprises mainly a seat body, several pairs of terminals and two catch hooks; the terminals are fixed onto the seat body; the two catch hooks are connected to the catch hook seat on two ends of the seat body; characterized in the installation of the positioning body inside the two side bodies of the catch hook, that when the pushing part on the upper part of the catch hook is pushed inward, the positioning body will push against the center part with a larger thickness on the first positioning body of the seat body, so the two side bodies of the catch hook will not directly push against the upper part with a smaller thickness on the first positioning body of the seat body; thus to effectively prevent the upper part of the first positioning body of the seat body from damage and breaking; and when the catch hook is securing the insert card, on the outside wall of the two side bodies of the catch hook is an insert body that may be inserted in the insert groove on the inside wall of the two side plates of the catch hook seat of the seat body; so the two catch hooks can be maintained at a securing status, to secure the insert card more steadily; and, on the inside wall of the first positioning body of the catch hook seat of the seat body is a step-shaped matching surface, so that when the ejecting part of the catch hook pushes the insert card upward to a certain extent, the step-shaped matching surface of the two side bodies of the catch hook will push against the matching surface of the catch hook seat and be secured in position; by so design of the step-shaped matching surface and the matching of larger areas, there will be no worry of sliding, and the catch hook will secure more steadily, without causing damage; besides, the edge of the keys of the catch hook is connected with a reinforcing body, to increase the strength and prevent breaking; and with the special design of the catch hook seat, it will prevent breaking, and the integral unit will enable the connector to have an extended service life.

To enable better understanding of the characteristics and technical contents of the subject invention, please refer to the following detailed description with drawings; however, the attached drawings are only for the purposes of reference and description, which shall not be based to restrict or limit the subject invention:

BRIEF DESCRIPTION OF NUMERALS

| | | | |
|---|---|---|---|
| 10 | seat body | | |
| 11 | insert slots | 12 | catch hook seat |
| 13 | side plate | 14 | center post |
| 15 | insert groove | 16 | first positioning body |
| 17 | matching surface | 18 | second positioning body |
| 19 | guide channel | 19a | pinhole |
| 20 | terminal | | |
| 21 | contact part | 22 | insert pin |
| 30 | catch hook | | |
| 31 | side body | 32 | pushing part |
| 32a | catch end | 33 | ejecting part |
| 34 | nonskid grain | 35 | key |
| 36 | reinforcing body | 37 | insert body |

-continued

| | | | |
|---|---|---|---|
| 38 | matching surface | 39 | positioning body |
| 39a | positioning surface | | |
| 40 | insert card | | |
| 41 | depressed groove | | |
| 10a | seat body | 11a | terminal |
| 12a | catch hook | 13a | insert groove |
| 14a | catching part | 15a | ejecting part |
| 16a | catch hook seat | 17a | positioning body |
| 18a | key | | |

DETAILED DESCRIPTION OF PREFERRED EMBODIMENT

Figure 1:
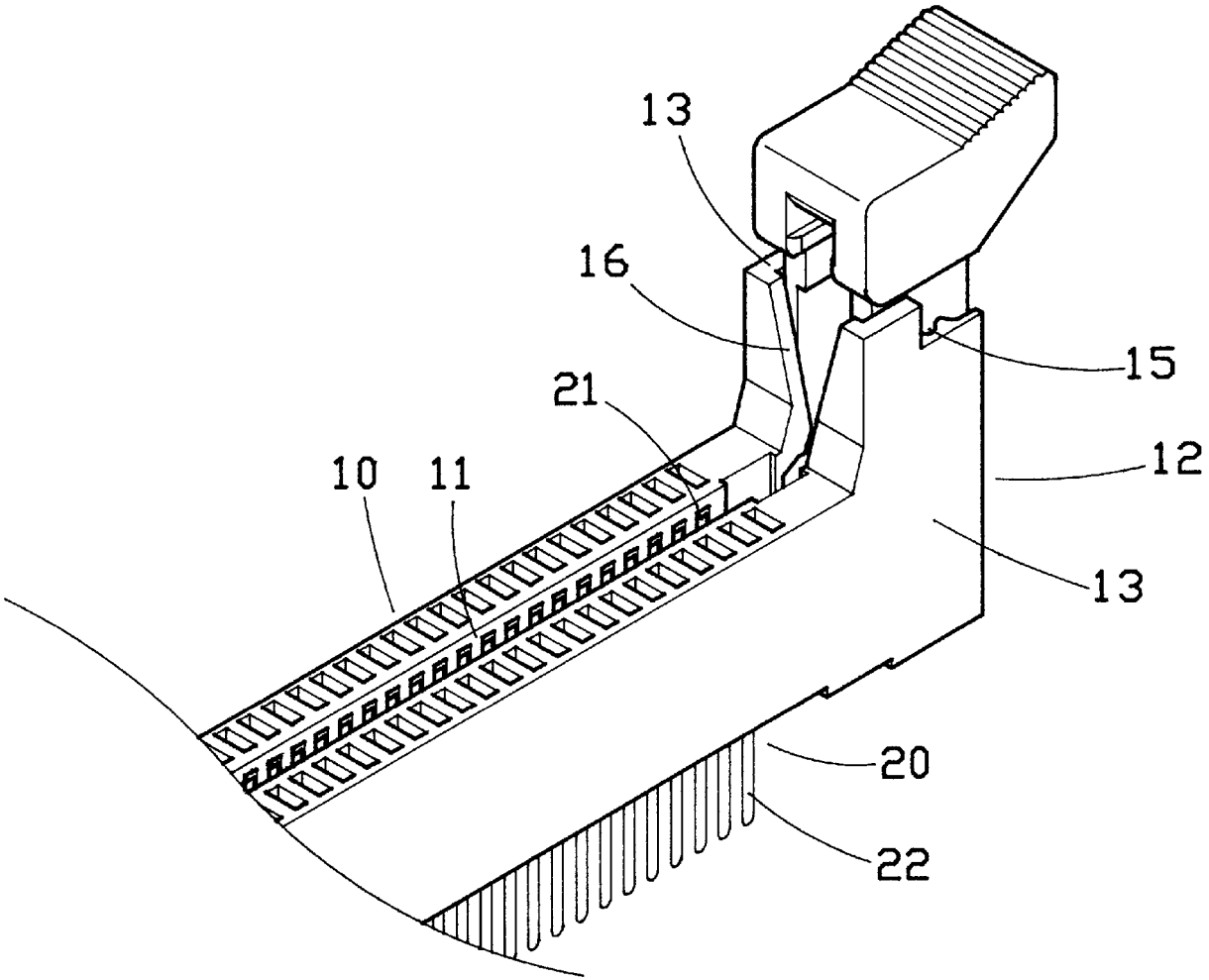
FIG. 1 is a perspective assembled view of the subject invention.
Figure 2:
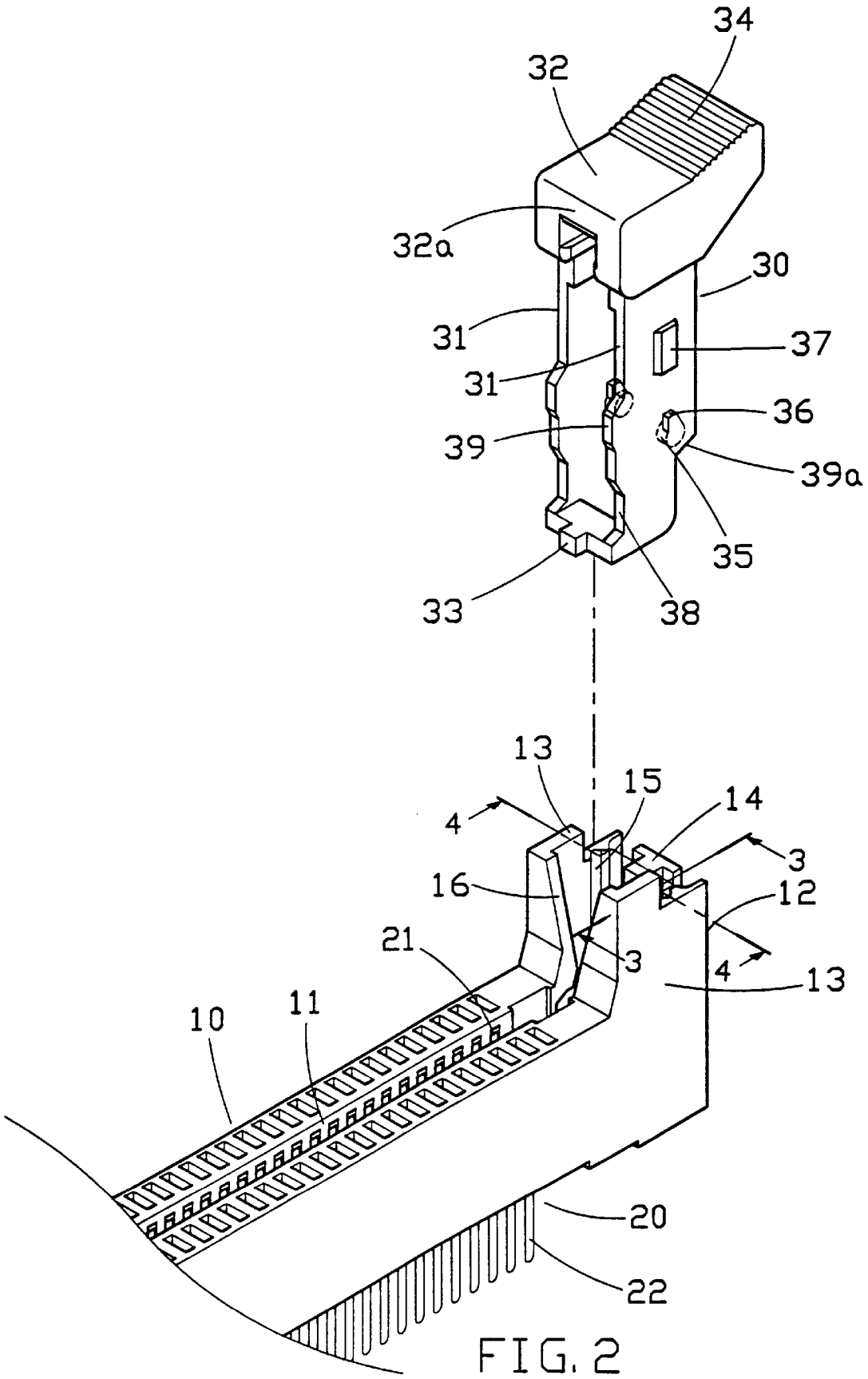
FIG. 2 is a perspective disassembled view of the subject invention.
Figure 4:
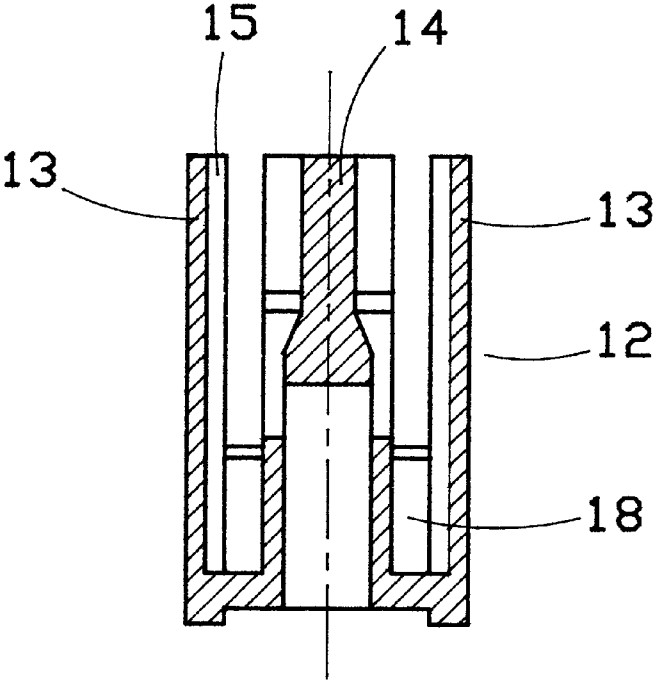
FIG. 4 is a side sectional view of the catch hook seat in the subject invention.
Figure 3:
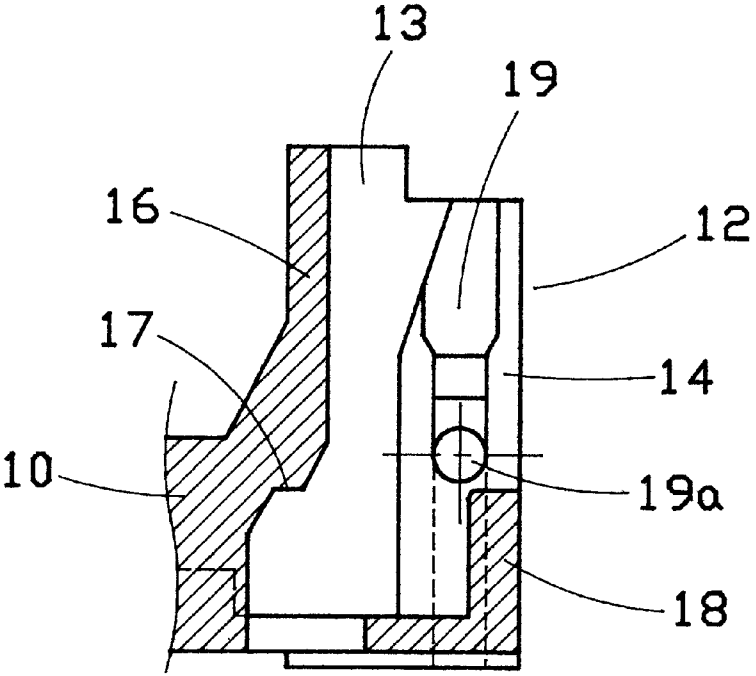
FIG. 3 is a front sectional view of the catch hook seat in the subject invention.
Figure 6:
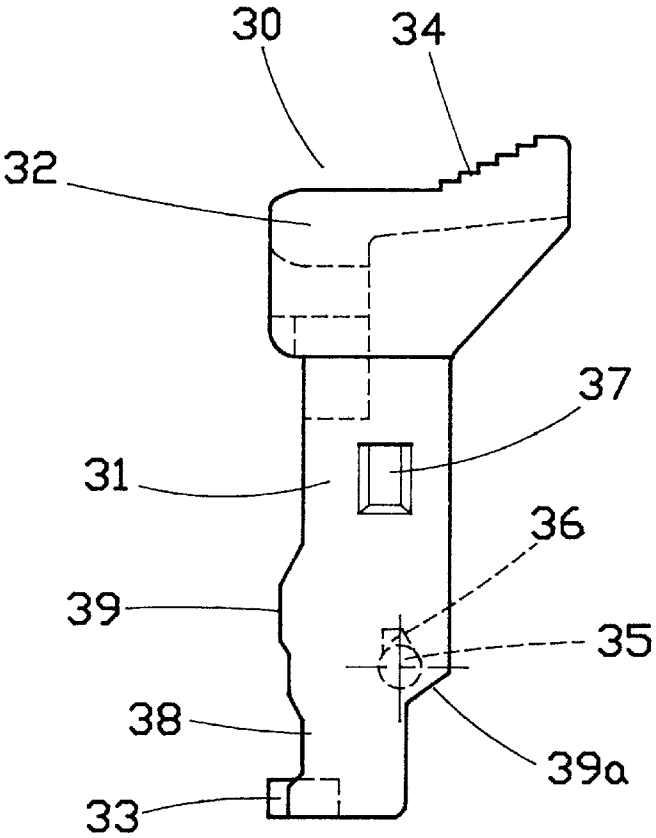
FIG. 6 is a side view of the catch hook in the subject invention.
Figure 5:
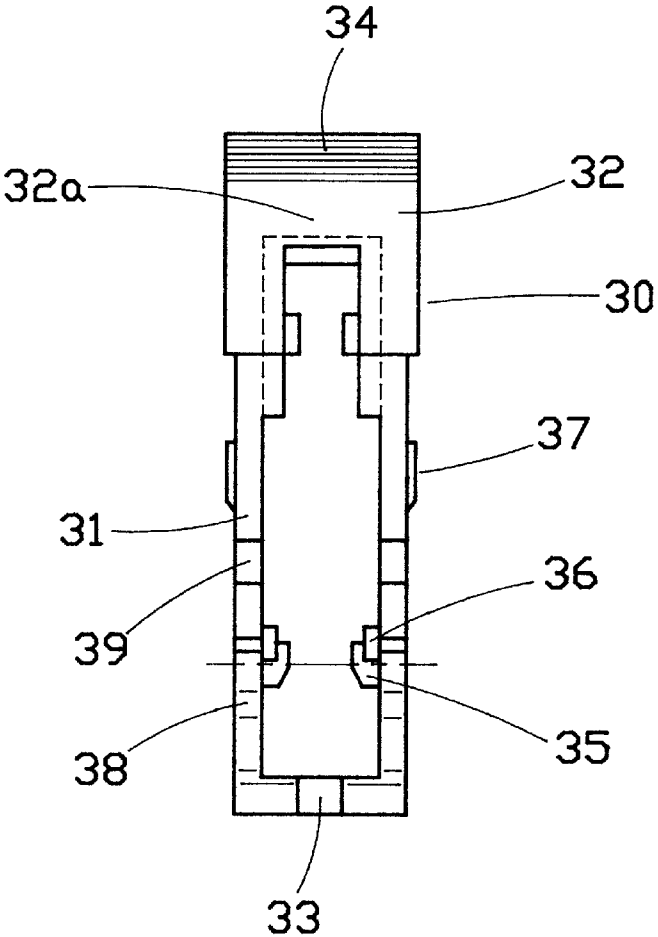
FIG. 5 is a front view of the catch hook in the subject invention.

Please refer to FIGS. 1 and 2 which are respectively a perspective assembled view and a perspective disassembled view of the subject invention. The subject invention relates to the presentation of a type of connector with ejecting and securing functions; said connector comprises mainly a seat body 10, several sets of terminals 20 and two catch hooks 30; wherein the seat body 10 is made of an insulating material such as plastics, etc.; its center portion having an insert slot 11 that opens upwards, serving to accommodate the insertion of interface cards or other cards; on the left and right sides of the seat body 10 are opposing catch hook seats 12; said catch hook seat is monoblock formed with the seat body 10; each catch hook seat 12 has two side plates 13 and a center post 14 (please refer simultaneously to FIGS. 3 and 4); on each of the inside walls of the two side plates is a vertically designed insert groove 15; protruding on the inner end of the inside walls of the two side plates is a first positioning body 16; on the inside wall of the first positioning body 16 is the formation of a step-shaped matching surface 17 that is composed of several sections of planes; the center plate 14 is located near the outside end between the two side plates 13; the lower halves of the center plate 14 and between the two side plates 13 is the formation of a second positioning body 18; on two sides of the center post 14 is respectively a vertically designed guide channel 19; the bottom end of the guide channel 19 is in open communication with a horizontally directed pinhole 19*a*.

The several sets of terminals 20 are fixed inside the seat body 10; the upper ends of said terminals have an insert card contact part 21, its lower ends are connected with insert pins 22; said insert card contact part 21 is exposed into the inert groove 11 of the seat body 10, so that an interface card or other cards may be connected with electricity when they are inserted in the insert groove 11; the insert pins 22 at the lower ends of the terminals 20 are exposed to the bottom of the seat body 10, which may be inserted and connected to the circuit board, so that said connector will accomplish the purpose of electrical connection between the insert cards and the circuit on the circuit board.

The catch hook 30 is located at the left and right ends of the seat body 10; said catch hook 30 is composed of two side bodies 31, a pushing part 32 and an ejecting part 33; the two side bodies 31 are joined as one unit by the pushing part 32 and the ejecting part 33; the pushing part 32 and the ejecting part 33 are respectively located on the upper and lower parts between the side bodies 31; the top side of the pushing part 32 has nonskid grains 34; on the pushing part 32 and facing the insert slot 11 is the formation of a catching end 32*a*; on the inside walls of the two side bodies 31 are protruding keys 35; the edge of the key 35 is connected with reinforcing body 36 to increase the strength; on the outside wall of the two side bodies 31 are insert bodies 37; on the lower part of the two side bodies 31 are step-shaped matching surface 38 that corresponds with the matching surface 17 on the catch hook seat 12; on the upper part of the matching surface 38 is a protruding positioning body 39; on the lower part outside the two side bodies 31 is a positioning surface 39*a*. The two catch hooks 30 are joined with the key 35 into the pinholes 19*a* on the catch hook seat 12 at the left and right ends of the seat body 10, so that the catch hook 30 is joined together by keys 35 to the catch hook seat 12 at two ends of the seat body 10; the catch hook 30 may sway on the key 35 as its fulcrum.

Figure 7:
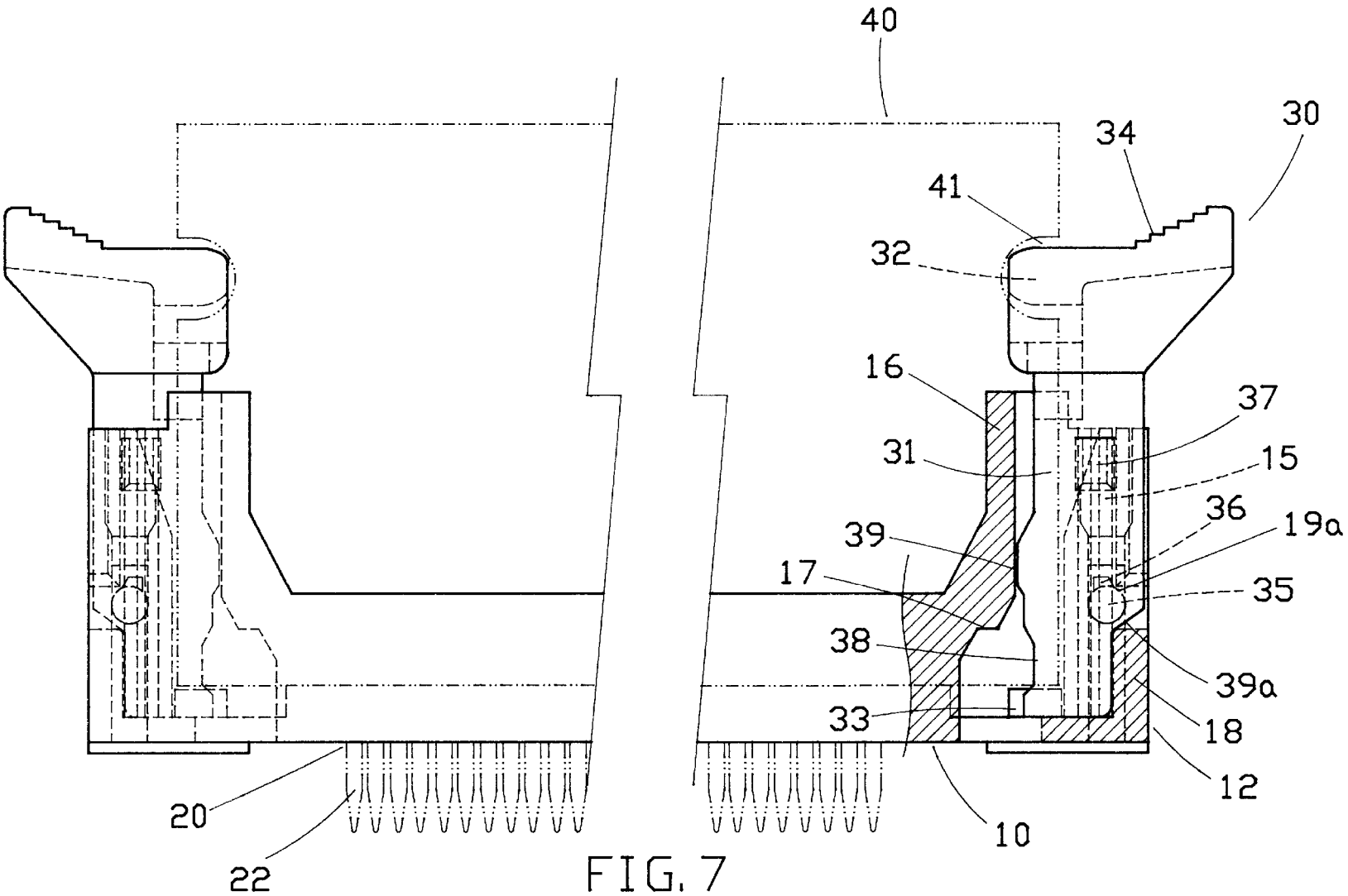
FIG. 7 is a view of the securing insert card of the subject invention in operation.

As illustrated in FIG. 7, when an interface card or other card 40 is inserted in the seat body 10 of the connector, the connector 32 on the upper part of the catch hook 30 may be pushed inward (toward the direction of the insert card), so that the upper part of the catch hook 30 may sway inward on the key as its fulcrum; the catch hook 30 may have its catching end 32*a* to fasten the insert card 40 and be installed in advance in the corresponding depressed groove 41, to enhance the solidarity of the inside ends of the two side bodies 31; by the installation of the positioning body 39 in the two side bodies 31 of the catch hook 30, when the pushing part 32 on the upper end of the catch hook 30 is pushed inward, the positioning body 39 will push against the thicker portion of the center part of the first positioning body 16 of the seat body 10, so that the two side bodies 31 of the catch hook 30 will not directly push against the upper part of the thicker portion of the first positioning body 16 of the seat body 10, thus it will effectively prevent broken or cracked upper part of the first positioning body 16 of the seat body 10; and when the catch hook 30 is securing the insert card 40, the insert body 37 on the outside wall of the two side bodies 31 of the catch hook 30 will be inserted into the insert groove 15 on the inside wall of the two side plates 13 of the catch hook seat 12 of the seat body 10, so the two catch hooks 30 may be maintained in a secured status, to secure the insert card 40 with a better effect.

Figure 8:
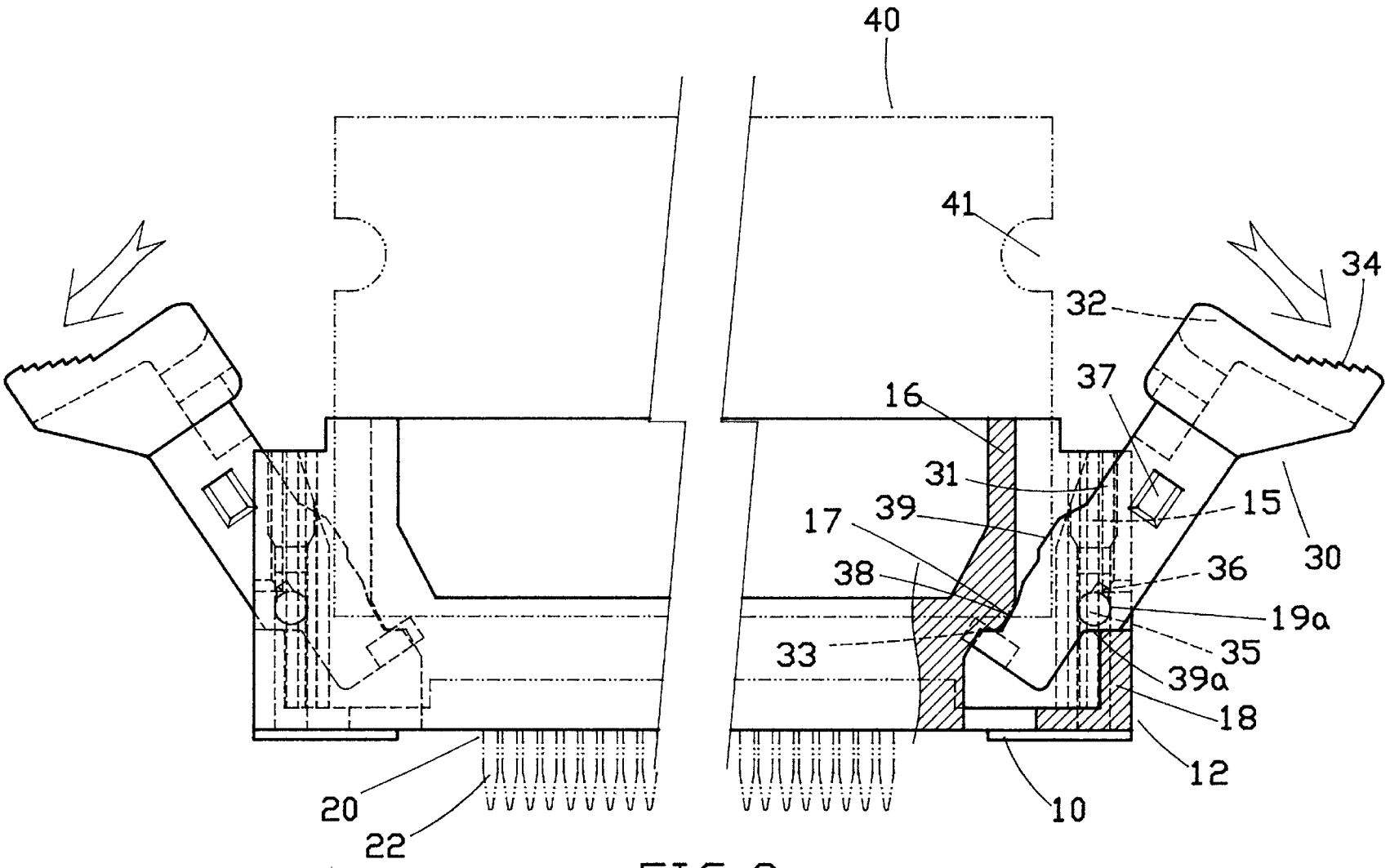
FIG. 8 is a view of the ejecting insert card of the subject invention in operation.
Figure 9:
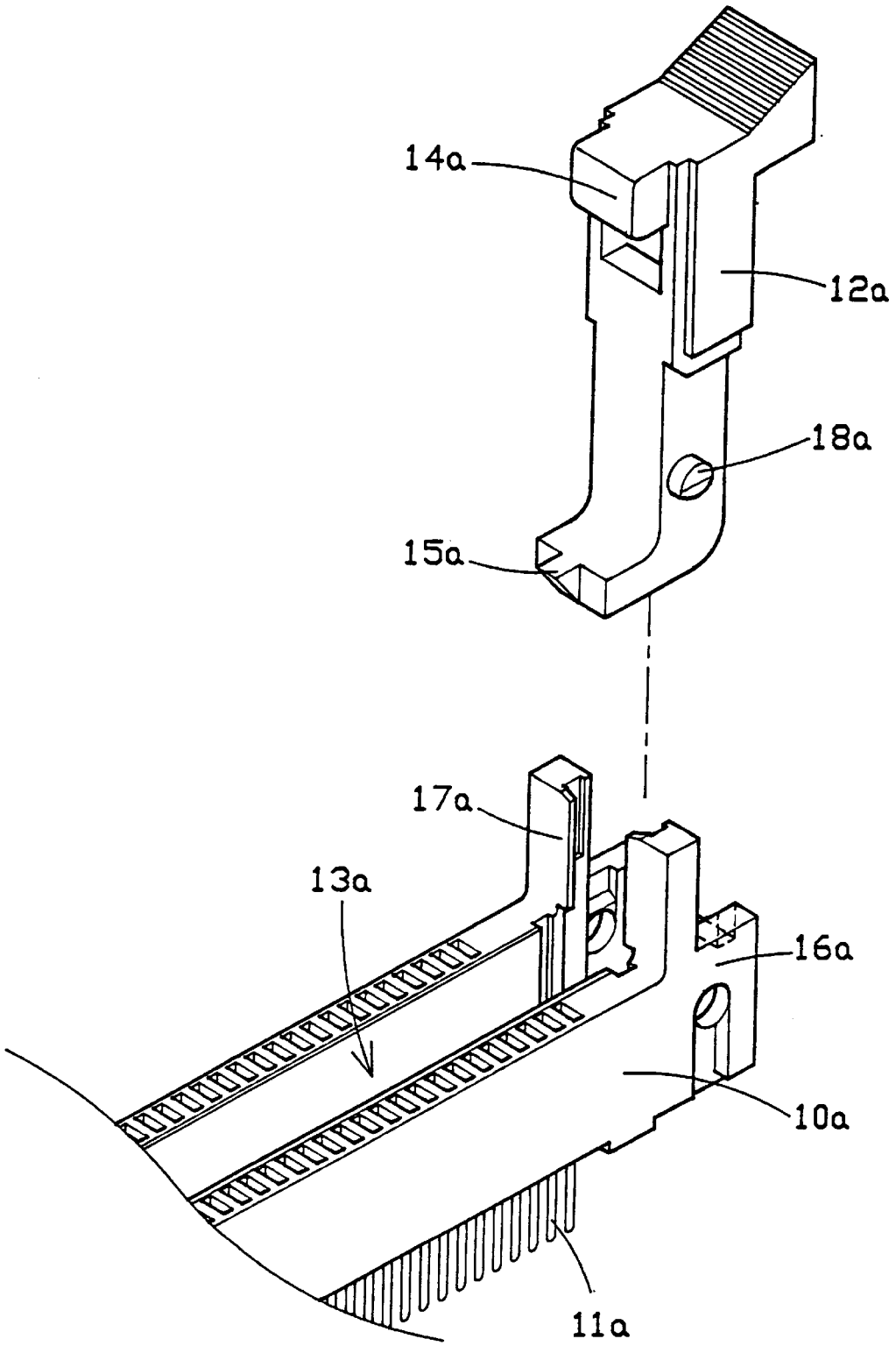
FIG. 9 PRIOR ART
FIG. 9 is a perspective disassembled view of a prior art of connector.

As illustrated in FIG. 8, if the insert card 40 is to be pulled out, the pushing part 32 on the upper end of the catch hook 30 may be pushed outward, so the upper part of the catch hook 30 will sway outward on the key 35 as its fulcrum, and the catching end 32*a* will get away from the depressed groove 41, and the insert body 37 on the outside wall of the two side bodies 31 of the catch hook 30 will slide out of the insert groove 15 on the inside wall of the two side plates 13 of the catch hook seat 12 of the seat body 10, to release the securing force on the two sides of the insert card 40; and simultaneously, it will drive the ejecting part 33 at the lower end of the catch hook 30 to move upward, to eject the bottom surface of the insert card 40, so that the insert card 40 will move upward away from the seat body 10 of the connector; the result is effortless pulling of the insert card out of the connector. The subject invention is characterized in that a step-shaped matching surface 17 is installed on the inside wall of the first positioning body 16 of the catch hook seat 12 of the seat body 10, so the ejecting part 33 of the catch hook 30 pushes upward on the insert card 40 to a certain extent, the step-shaped matching surface 38 of the two side bodies 31 of the catch hook 30 may push against the matching surface 17 of the catch hook seat 12 and be secured in position; by the step-shaped design and the matching of a larger area of the matching surfaces 38 and 17, there will be no worry of loosening, so that the catch hook 30 can be secured in place; without the weaknesses of frequent damage on the catch hook resulting from inability to fit in place and easy loosening due to the smaller area of contact between the catch hook and the catch hook seat in a prior art; moreover, when the ejecting part 33 of the catch hook 30 ejects the insert card 40 upward to a certain extent, the positioning surface 39*a* on the outer end of the two side bodies 31 of the catch hook 30 will also push against the second positioning body 18 of the catch hook seat 12 of the seat body 10, so the catch hook 30 can be more securely fixed in position; also, the special design of the catch hook seat 12 will enable better prevention of breakage or cracking of the subject invention.

Summing up, the subject invention, with effective improvement on the weaknesses in a prior art of connector, such as broken parts, cracked parts, failure of catch hook to have excellent fastening and positioning functions, easy loosening, inability to secure the insert cards, etc., is indeed an unprecedented invention with its originality and inventive step that will fully satisfy the requirements for a patent right, and this application is filed in accordance with the Patent Law to protect the subject inventor's rights and interests. Your favorable consideration should be appreciated.

It is hereby declared that the subject description, covering only the preferred embodiment of the subject invention, should not be based to limit or restrict the subject claim, and that all equivalent structural/configurational variations deriving from the subject description and drawings and contents therein should reasonably be included in the intent and scope of the subject claim.

I claim:

1. A connector with ejecting and securing functions, comprising:

a seat body, said seat body comprising an insert slot and a pair of catch hook seats respectively formed on opposing ends of the seat body, each of said catch hook seats having two side plates and a center post, an inside wall of each of the two side plates having an insert groove and a first positioning body formed therein, an inside wall of each first positioning body having a first step-shaped matching surface formed thereon, a guide channel is formed on two sides of the center post, and a pinhole is formed through the center post in open communication with a bottom portion of each guide channel;

a plurality of pairs of terminals fixed on the seat body; and two catch hooks, each said catch hook being composed of (a) two side bodies, (b) a pushing part coupled to a respective upper end of said two side bodies, and (c) an ejecting part coupled to a respective lower end of said two side bodies, the pushing part having an inner end facing the insert slot, the inner end having a catching end formed therein, each of the two side bodies having an insert body formed on an outer will thereof for insertion into a respective insert groove of the catch hook seat and a key projecting from an inner wall, each of the two side bodies having a second step-shaped matching surface formed thereon corresponding to the first matching surface of the catch hook seat, said second matching surface having a positioning body protruding therefrom for pushing against a center part of the first positioning body of a respective catch hook seat, said two catch hooks each being joined by insertion of each key into a respective opening of a corresponding one of the pinholes of the pair of catch hook seats.

2. The connector with ejecting and securing function functions, as recited in claim 1, wherein a second positioning body is formed between the two side plates and the center plate of each catch hook seat, each catch hook having a positioning surface that pushes against the second positioning body of the catch hook seat.

* * * * *